United States Patent [19]

Harris et al.

[11] Patent Number: 4,601,363

[45] **Date of Patent: * Jul. 22, 1986**

[54] LARGE DIESEL ENGINE EXHAUST MUFFLER

[76] Inventors: Theodore R. Harris, 14 El Patio, Orinda, Calif. 94563; Richard T. Harris, 3127 Stanley Blvd., Lafayette, Calif. 94549

[ * ] Notice: The portion of the term of this patent subsequent to Dec. 4, 2001 has been disclaimed.

[21] Appl. No.: 668,660

[22] Filed: Nov. 6, 1984

[51] Int. Cl.[4] ..... F01N 1/12

[52] U.S. Cl. ..... 181/280; 181/268; 181/272

[58] Field of Search ..... 181/252, 265, 268, 255, 181/264, 272, 279, 280, 281

[56] References Cited

U.S. PATENT DOCUMENTS

| | | | |
|---|---|---|---|
| 1,612,584 | 12/1926 | Hunter et al. | 181/279 |
| 3,235,003 | 2/1966 | Smith | 165/135 |
| 3,393,767 | 7/1968 | Monk | 181/67 |
| 3,963,092 | 6/1976 | Soares | 181/44 |
| 4,050,539 | 9/1977 | Kashiwara | 181/280 |
| 4,109,753 | 8/1978 | Lyman | 181/252 |
| 4,140,204 | 2/1979 | Wilson | 181/268 |
| 4,165,798 | 8/1979 | Martinez | 181/268 |
| 4,203,503 | 5/1980 | Franco et al. | 181/272 |
| 4,317,502 | 3/1982 | Harris et al. | 181/280 |
| 4,485,890 | 12/1984 | Harris et al. | 181/280 |

FOREIGN PATENT DOCUMENTS

| | | | |
|---|---|---|---|
| 23743 | 8/1936 | Australia | 181/280 |
| 1301824 | 8/1969 | Fed. Rep. of Germany | 181/280 |
| 804593 | 8/1936 | France . | |
| 1087417 | 8/1954 | France . | |
| 641878 | 7/1962 | Italy | 181/280 |
| 266706 | 3/1928 | United Kingdom . | |
| 297871 | 10/1928 | United Kingdom | 181/280 |
| 426847 | 4/1935 | United Kingdom . | |

*Primary Examiner*—Benjamin R. Fuller
*Attorney, Agent, or Firm*—James R. Cypher

[57] ABSTRACT

A muffler for large internal combustion diesel engines in which the structure cancels sound waves by interference. The gases generally flow in one direction through the muffler with intermittant flow reversal occurring only upon acceleration. The muffler is formed with a plurality of longitudinal chambers divided by reflection walls. Edge echo openings in the reflection walls permit limited gas entry into the chambers. A plurality of helical members surrounded by a large open tube and pierced by a small open tube channel all of the gases through a bulkhead wall which divides the muffler housing into two volumetrically generally equal portions. The chambers on either side of the tube and helical member cluster are substantially longer than the tubes joined by the helix members.

9 Claims, 24 Drawing Figures

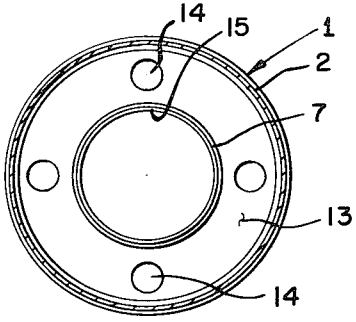
FIG. 6
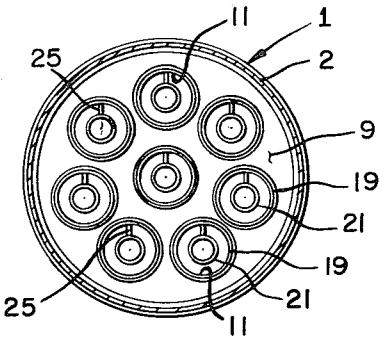
FIG. 7
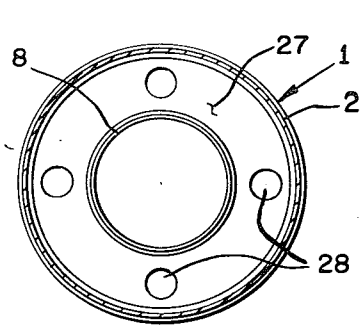
FIG. 8
FIG. 9
FIG. 7A
FIG. 8A
FIG. 7C
FIG. 7B
FIG. 8B

LARGE DIESEL ENGINE EXHAUST MUFFLER

BACKGROUND OF THE INVENTION

This invention relates to mufflers for large displacement internal combustion diesel engines mounted in large highway trucks and large stationary engines such as engines of 300 horse power.

This muffler resulted from a need for a muffler which would reduce the back pressure and thereby give better performance and increase mileage while at the same time reducing the sound level.

Our engine exhaust mufflers disclosed in U.S. Pat. No. 4,307,502 granted Mar. 2, 1982 and U.S. application, Ser. No. 06/509,992 filed June 30, 1983 now U.S. Pat. No. 4,485,890 granted Dec. 4, 1984 did not meet the requirements for large diesel trucks for noise levels.

SUMMARY OF THE INVENTION

The muffler of the present invention for large diesel trucks and other heavy equipment has a housing case which is substantially longer than automobile and light truck mufflers. Further, the length to diameter ratio is substantially greater than length to diameter ratio of automobiles and light trucks.

The muffler of the present invention has the same "tube within a tube" and a helix member interposed between the two tubes as my co-pending application for ENGINE EXHAUST MUFFLER, Ser. No. 06/509,992, now U.S. Pat. No. 4,485,890, granted Dec. 4, 1984 supra but with the very important difference that there is a cluster of these special tubes; hereafter referred to as "tube cluster". Equally important is the fact that the tube cluster is mounted in the housing with elongated chambers on either side which are substantially longer than the tubes in the cluster.

The combination of the long chambers on either side of the tube cluster unexpectedly results in a decibel level which is within government specifications and also results in a more acceptable and deeper tone level which truckers find more acceptable than state of the art mufflers.

Another objective is to reduce the back pressure in the exhaust especially in turbo equipped diesel engines, thereby reducing the temperature in the exhaust which translate to an increase in available power. The cross sectional areas of the openings in the tubes in the tube cluster are equal to or slightly exceed the diameter of the inlet exhaust pipe.

BRIEF DESCRIPTION OF THE DRAWINGS

FIG. 6 is a cross sectional view of the muffler taken along line 6—6 of FIG. 5.

FIG. 7 is a cross sectional view of the muffler taken along line 7—7 of FIG. 5.

FIG. 7A is a cross sectional view of another form of the muffler taken along the same location as line 7—7 of FIG. 5.

FIG. 7B is a cross sectional view of still another form of the muffler taken along the same location as line 7—7 of FIG. 5.

FIG. 7C is a cross sectional view of yet another form of the muffler taken along the same location as line 7—7 of FIG. 5.

FIG. 8 is a cross sectional view of the muffler taken along line 8—8 of FIG. 5.

FIG. 8A is a cross sectional view of the modified form of the muffler illustrated in FIG. 7A and is taken along the same location as line 8—8 in FIG. 5.

FIG. 8B is a cross sectional view of the modified form of the muffler illustrated in FIG. 7B and is taken along the same location as line 8—8 in FIG. 5.

FIG. 9 is a cross sectional view of the muffler taken long line 9—9 of FIG. 5.

DESCRIPTION OF THE INVENTION

Figure 1:
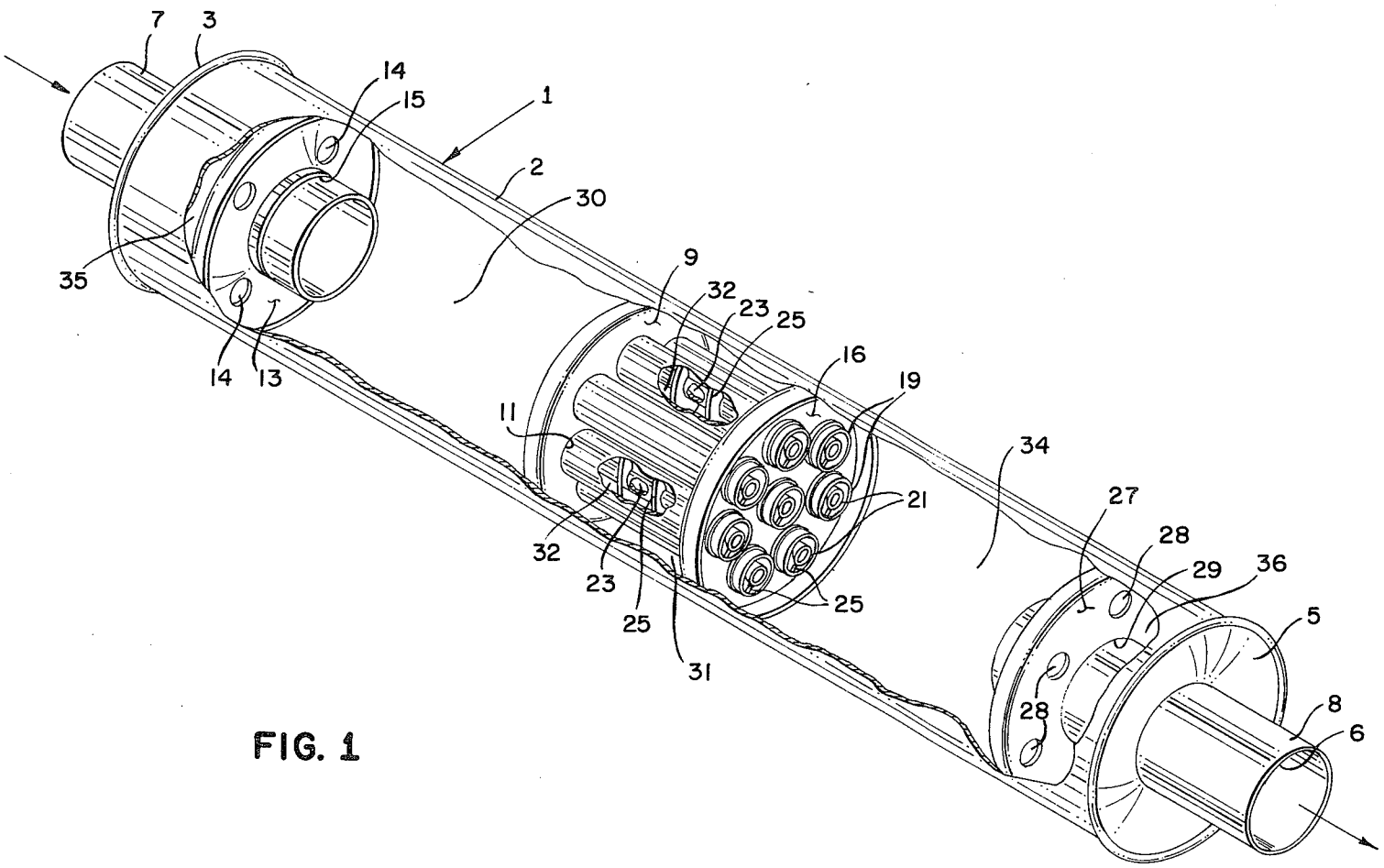
FIG. 1 is a perspective view of the muffler of the present invention with portions cut away for purposes of illustration.
Figure 2:
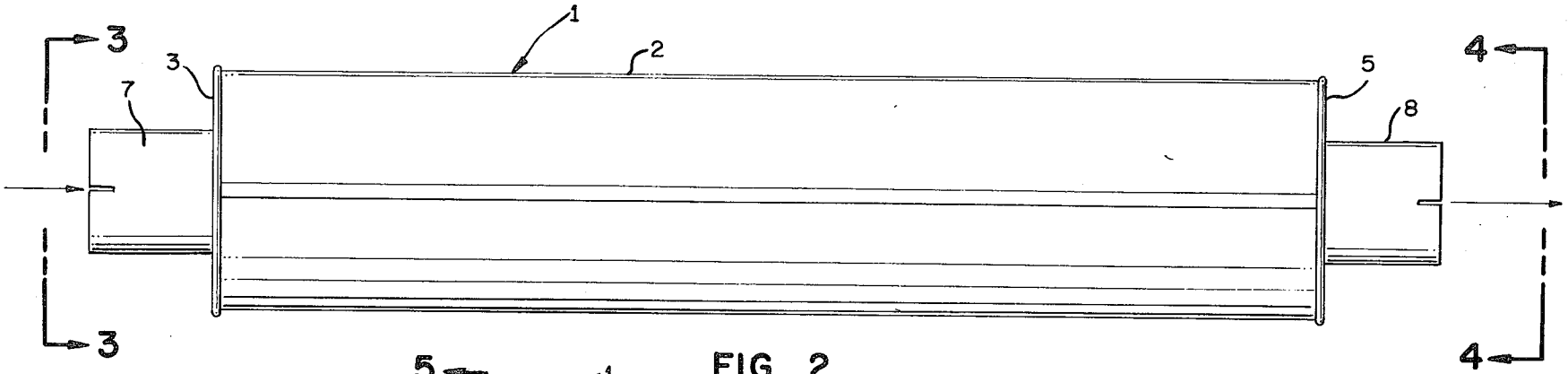
FIG. 2 is a top plan view of the muffler shown in FIG. 1.
Figure 4:
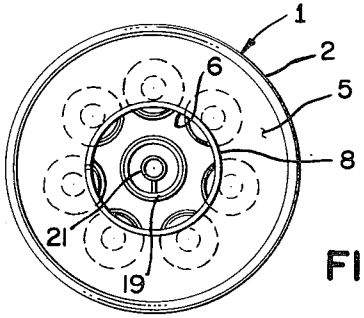
FIG. 4 is an end view of the discharge end of the muffler shown in FIG. 2 and taken along line 4—4.
Figure 3:
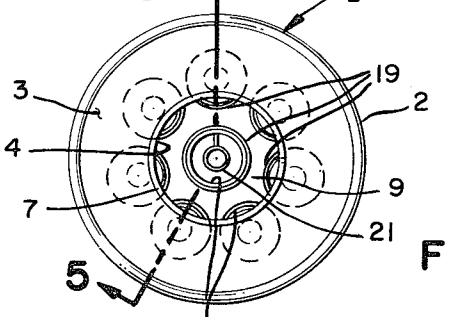
FIG. 3 is a front end view of the muffler shown in FIG. 2 taken along lines 3—3.

The muffler of the present invention is constructed so that the exhaust gases from an internal combustion diesel engine travel from the upstream side of the muffler to the downstream side in generally the same direction as contrasted with standard mufflers in which a series of baffles cause the exhaust gases to follow a tortuous route, changing direction several times and even traveling in the opposite direction. The muffler thus gives greater performance and without any sound absorbent materials which cause moisture to condense within the muffler and result in damaging rusting.

The present muffler was designed to reduce the sound level within required limits while creating a sound which is not objectionable.

The type of sound of the present muffler may be described as having a lower tone than standard truck mufflers which is probably caused by the reflecting walls and the mixing of the swirling gases imparted by the helixes and the direct pulsing gases emitting from the inner small tubes. The deeper tones also result from the oversize chambers on either side of the tube cluster. The sound is found to be pleasant because there is a multiplication of different frequencies resulting in a harmonic blending with the fundamental tones passing through the inner small tubes. The multiple frequencies are believed to result from passage of the pulsating exhaust through the helical swirl chambers and passage of exhaust through the multiple echo hole openings in the internal walls.

The internal combustion diesel engine muffler of the present invention consists of an elongated housing 1 having a curvilinear side wall 2, an inlet end wall 3 formed with a first inlet opening 4, and an outlet end wall 5 formed with a first outlet opening 6; and inlet tube 7 connected to the inlet end wall and communicating with the first inlet opening in the inlet end wall; and outlet tube 8 connected to the outlet end wall and communicating with the first outlet opening in the outlet end wall; a first internal reflection wall 9 axially spaced downstream from the inlet end wall forming a close fit with the curvilinear side wall and formed with large tube openings 11; a second internal reflection wall 13 spaced between the inlet end wall and the first internal reflection wall forming a close fit with the curvilinear side wall and formed with first edge echo openings 14 therethrough and a second inlet tube opening 15; the inlet tube communicates with the second inlet tube opening in the second internal reflection wall and is connected to the second internal reflection wall; a bulkhead wall 16 axially spaced downstream from the first internal reflection wall forms a close fit with the curviliner side wall and is formed with large tube openings 17 axially aligned with the large tube openings in the first internal reflection wall; elongated large tube members 19 connected to and extending from the first internal reflection wall to the bulkhead wall and communicating with the large tube openings in the first internal reflection wall and the bulkhead wall and connected to the bulkhead wall; small tube members 21 coaxially mounted within the large tubes forming open ended pulse chambers 23; elongated helical members 25 joining the small tubes and the internal large tube members; a third internal reflection wall 27 axially spaced downstream from the bulkhead wall forming a close fit with the curvilinear side wall and formed with second edge echo openings 28 therethrough and a second outlet tube opening 29 formed in alignment with the outlet opening in the outlet end wall; the outlet tube is in communication with the second outlet tube opening in the third internal reflection wall, and is connected to the third internal reflection wall; a primary expansion chamber 30 is formed by the curvilinear side wall, the second internal reflection wall and the first internal reflection wall; helical elongated swirl and pulse smoothing chambers 32 are formed between the small tubes and the large tubes and defined by the helical members; and a primary interference chamber 34 is formed by the curvilinear side wall, the bulkhead wall and the third internal reflection wall; a first accelleration expansion chamber 35 formed by the curvilinear side wall, the inlet end wall, and the second internal reflection wall; and a second acceleration expansion chamber 36 is formed by the curvilinear side wall, the third internal reflection wall and the outlet end wall. The length of primary expansion chamber 30 is substantially greater than the distance between first reflection wall 9 and bulkhead wall 16. Further, the length of primary interference chamber 34 is substantially greater than the distance between first reflection wall 9 and bulkhead wall 16.

The outlet tube length extends a distance upstream beyond the third reflection wall. It has been found that as this distance becomes shorter, the noise level increases.

The location of the cluster of helix tubes plays a major role in the satisfactory performance of the muffler. The exact location is not critical, but an optimum working muffler appears to result when the cluster is located at the mid-portion of the housing.

The alignment of the inlet tube, small inner tubes and outlet tube may vary. It has been discovered, however, that satisfactory operation may be achieved even when one of the aforesaid tubes are in substantial alignment with the inlet and outlet tubes. This fact can be readily observed by actually looking through either end of the muffler and seeing completely through the muffler.

The present muffler may have various shapes such as cylindrical, but an oval appears to operate optimally also.

The present muffler may be formed so that the inlet tube enters the inlet end wall at a location offset to the center of the wall and the outlet tube also is located at a position offset to the center of the outlet wall.

It has been found that the muffler operates satisfactorily when the outlet tube is centered in the outlet wall.

Construction of the sidewalls of the muffler are 16 gauge double-wrapped; inner galvanized to inhibit acid and water corrosion with an outer wrap of aluminum clad steel to inhibit road salt corrosion.

The end walls are 16 gauge coated steel.

Pressed and rolled seams, not crimped, should be provided for durability and to withstand the pressure of backfires.

It has been found that the muffler heats up uniformly within a few minutes of operation so there are no hot or cold spots where moisture collects or vaporizes. The helix members are 16 gauge coated steel.

The housing typically is 44" long and 9" in diameter. Inlet and outlet tubes are 5" in diameter and a length of 12" with 4" of the tube extending beyond the end walls of the housing.

The inlet and outlet tubes are welded to one end wall or internal wall only. Thus expansion and contraction of the exhaust system longitudinally will not break the welds.

The large tube members also are welded to one internal wall. The tubes are preferably 7" in length with an outside diameter of 2". The tubes are preferably 16 gauge. The helical auger may be formed with a 2" pitch and both ends are welded to both the inner small tube members and the large tube members. The auger is sized to fit snugly between the two tubes.

The inner small tube members are 7" long and have an outside diameter of 13/16".

The three internal reflection walls and the bulkhead wall are preferably formed with perimeter flanges and are spot welded to the inner wall of the housing.

Figure 5:
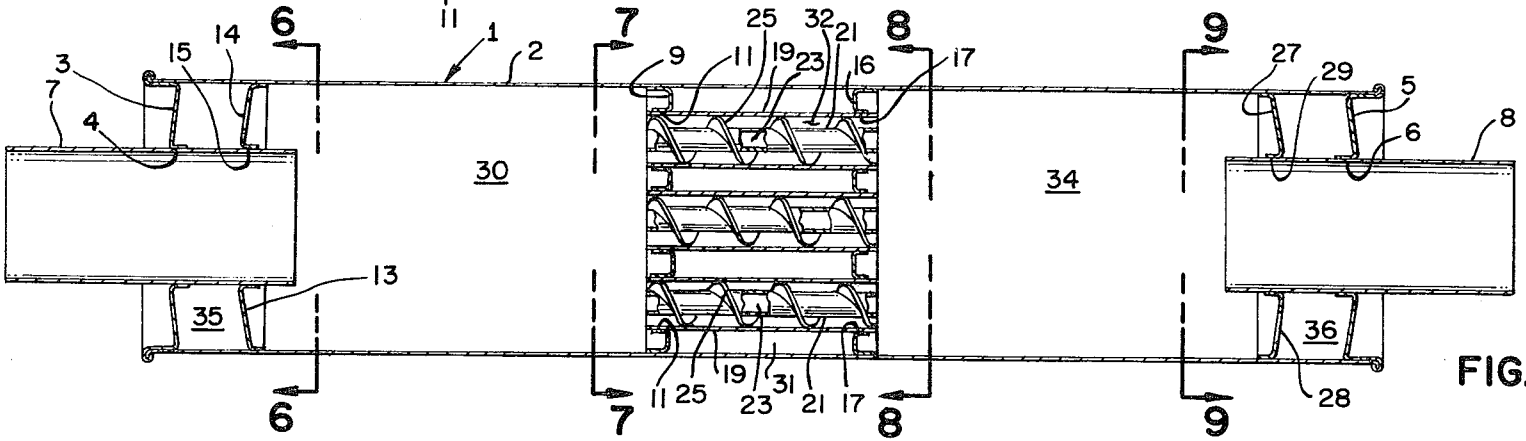
FIG. 5 is a cross sectional view of the muffler taken generally along line 5—5 of FIG. 3 with selected portions cut away for purposes of clarity.
Figures 10, 11, 12, 13, 14:
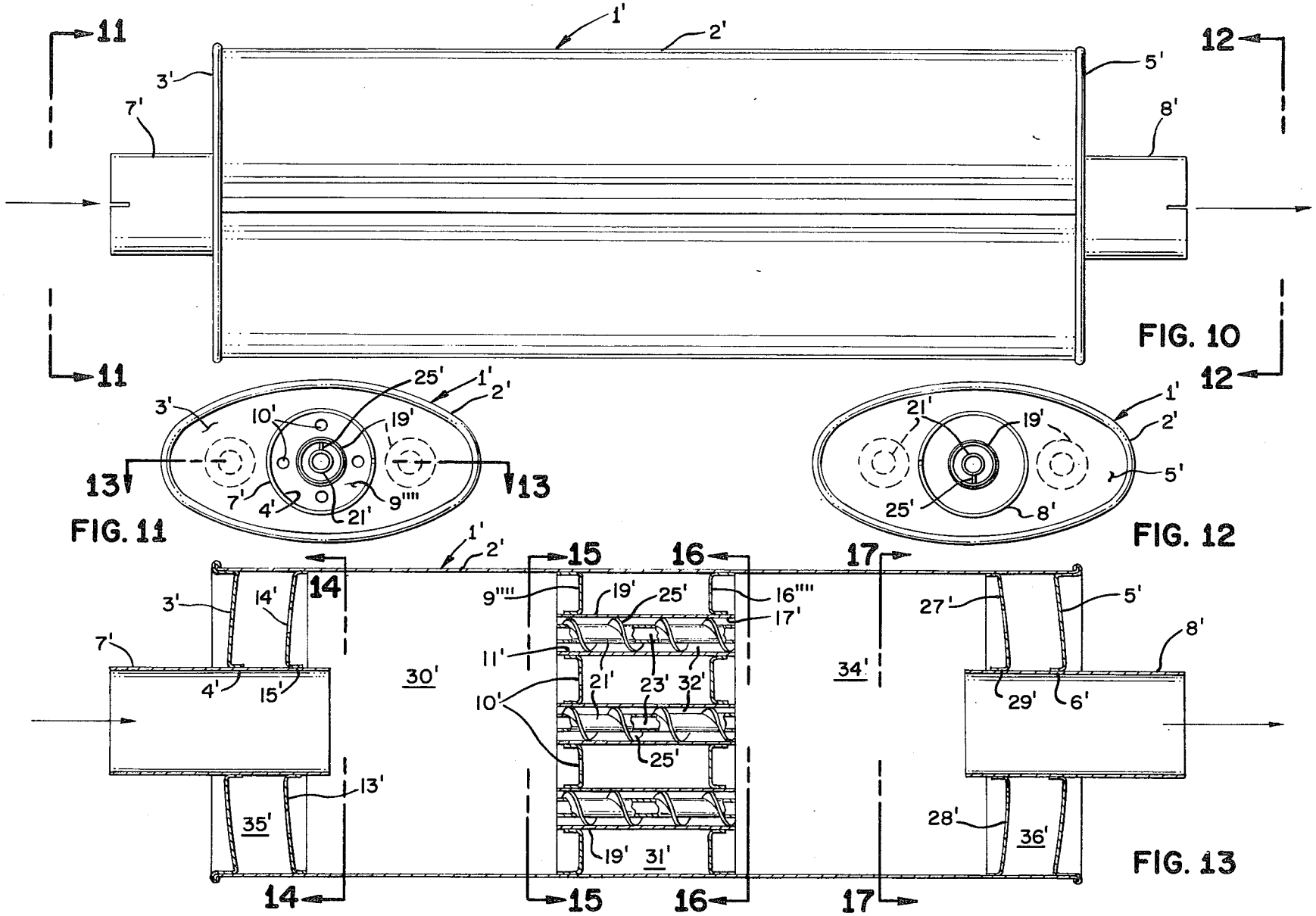
FIG. 10 is a top plan view of another form of the invention.
FIG. 11 is a side view of the muffler of FIG. 10 taken along line 11—11.
FIG. 12 is a side view of the muffler of FIG. 10 taken along line 12—12.
FIG. 13 is a cross sectional view of the muffler shown in FIG. 11 taken along line 13—13.
FIG. 14 is a cross sectional view of the muffler of FIG. 13 taken along line 14—14.
Figure 14:
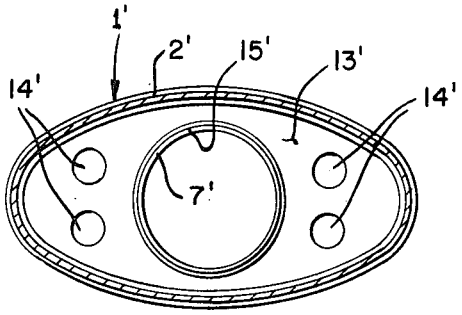

A modified form of the muffler is illustrated in FIG. 7C. The first reflector wall here shown as wall 9' is identical to wall 9 shown in FIG. 7 except that a plurality of third echo openings 10 are formed therethrough. Placing openings in the wall opens up a third acceleration expansion chamber 31 which is indicated on FIG. 5.

TURBO

The present muffler with its reduced back pressure has been found ideal for turbo equipped engines. The lower back pressure increases the pressure difference across the turbine, therefore increasing the efficiency of the turbine.

Operation of the muffler resulting in better acceleration is as follows: When an engine is accelerating in speed, higher pressures and a greater volume of exhaust gas is generated. The hot exhaust gases enter the muffler through inlet tube 7 and first pass in a series of rapid pulses into primary expansion chamber 30. The rapid buildup in pressure immediately causes an increase in pressure and flow through the pulse chambers 23 and the swirl and pulse smoothing chambers 32. Without the possibility of dissipating the pressure, back pressure would increase and acceleration would be retarded as in a standard muffler and in the muffler set forth in U.S. Pat. No. 4,317,502 and all other mufflers known. The modified muffler is provided with a primary acceleration expansion chamber 31 which permits a further pressure buildup in a relatively large chamber. Pressure buildup is also permitted in a first acceleration expansion chamber 35. Some pressure build-up also occurs in the primary interference chamber 34 and in the second acceleration expansion chamber 36.

The reduction of pressure in the large primary expansion chamber 30 results in a reduction of sound level. Instead of the hot gases suddenly striking a metal surface, the gases entering the large primary expansion chamber strike a volume of hot air before contacting the reflection wall 9. Further, because the pressure is quickly dissipated, the hot gases strike a volume of gases under lower pressure. In like manner, the gases discharging from chambers 23 and 32, strike a large volume of gases which are cooling in chamber 34 before striking wall 27.

Noise level at start-up is greatest in most trucks. This results from hot gases from the engine striking cold air in the muffler. In standard mufflers, the noise level is not abated until the entire muffler is heated. In the present muffler, heating is in two stages so the muffler noise is abated within a shorter time and finally is further quieted as the entire muffler is heated. Two stage heating results from the construction of the muffler in two nearly equal volumes separated by the cluster of tubes with helixes.

All of the hot gases from the engine are initially forced into the primary expansion chamber 30, and the first acceleration expansion chamber 35. The initial warm-up of the upstream half of the muffler quickly reduces the temperature differential between the entering engine gases and the temperature of the gas in the muffler thereby quickly quieting the exhaust sound. As the engine continues to operate, the chambers on the downstream side of the bulkhead wall warm up and the temperature tends to equalize.

Sound level is largely a function of the ability of the muffler to convert rapid impulses of high pressure hot gases to a smooth non-pulsing flow of cooler gases to the cooler atmospheric air. This is accomplished in the following manner. All of the chambers set forth above permit expansion and cooling of the gases.

Gases flowing through the swirl and pulse smoothing chambers 32 cause a rapid dissipation of the pressure pulses.

Sound level is also decreased by a mixing of the pulsing gases by what is known as interference of sound waves. This interference phenomenon occurs primarily in primary interference chamber 34. Gases discharging from the swirl and pulse smoothing chambers 32 are caused to swirl by the helix members. These swirling gases mix with more rapidly moving gases being discharged through pulse chambers 23.

Of course, pressure pulses are also removed by the reflection of the gases between the reflection walls of each of the chambers.

Some further noise reduction occurs at each of the edge echo openings by a phenomenon known as "echo" caused by the gases attempting to pass by the sharp edges of a narrow opening between two large chambers. The edges cause a compression of the gases resulting in a change in frequency of the pressure waves thereby resulting in interference and canceling of the sound waves.

Finally, all noises are more easily tolerated if the sound is a blend of harmonics. Just as an orchestra playing discordant sounds can sound very irritating and an orchestra with the various instruments playing in harmony can sound very good even through still playing loud; so too a muffler emitting harmonic sounds, sounds less irritating than one sounding one or more loud discordant sound frequencies.

In the present muffler, the various parts are "tuned" to produce harmonic sound frequencies. These different sounds are produced by various elements in the muffler. First, the hot gases discharging from inlet pipe 7 into primary expansion chamber 30 create a sound at a relatively low frequency. Gases passing third echo edge opening 10 create a high frequency sound. Gases entering at a lower velocity into third accelleration expansion chamber 31 create a low frequency sound. Gases passing echo edge opening 14 into small second accelleration expansion chamber 35 create a high frequency sound. The gases passing into the small first accelleration chamber 35 strike the inlet end wall and create a medium frequency tone.

Gases passing through the swirl and impulse smoothing chambers 32 create a plurality of sounds at different frequencies as they pass through the helical members. At the same time, the inner small tubes 21 create a fundamental tone.

The passing of the swirling gases and the direct impulse gases from the small tubes 21 mix in the primary interference chamber and break up into a multiplicity of sounds. Of course, the second echo edge opening 28 creates a high frequency sound and a low frequency sound is created in the second accelerating chamber 36.

Reverberation takes place in all of the chambers and even the length of outlet tube 3 extending into chamber 34 affects the noise level.

The following quotation is taken from *Mechanical Engineers' Handbook,* Lionel S. Marks, 5th ed., McGraw Hill Book Co., Copyright 1951.

> "Exhaust back pressure should be kept to a minimum since an increase of 1 psi in back pressure decreases the maximum power output about 2½ percent, about 1 percent being due to more exhaust work and the balance to the effect of increased clearance gas pressure on volumetric efficiency."

In the present muffler, the combined cross sectional area of the first and second inner small tube members 21 and the open area between the large tube members 19 and the small tube members 21 is greater than either of the individual cross sectional areas of inlet tube 4 and outlet tube 8. Because of this relationship, there is no restricting area within the muffler to cause further compression of the gases. This is contrary to standard mufflers which have constricting areas within the muffler.

The muffler illustrated in FIG. 1 is the preferred configuration for the largest of the truck diesel engines. Eight tubes are shown in the tube cluster with seven of the tubes evenly spaced around a central tube. For diesel engines of smaller displacement, fewer tubes should be used so that the cross sectional area of the openings through the tubes in the cluster will more nearly match the cross sectional area of the inlet exhaust pipe.

In FIG. 7A which corresponds to FIG. 7 and FIG. 8A which corresponds to FIG. 8, only three, large tubes 19 are shown connecting reflection wall 9'' and bulkhead wall 16''. Small open ended tubes 21 are placed in the center of the large tubes 19 and a helical member 25 is placed between the tubes. For ease in manufacturing different mufflers, the tubes and helix members may be identically dimensioned as the tubes and helix members previously described. To fine tune the cross sectional area of the gas openings through the tube cluster, the tube diameters may be increased or decreased accordingly. The geometric arrangement of the tubes has not been found to be critical and therefore the two additional representations are simply illustrative of many possible geometric arrangements.

FIG. 7B corresponds to FIG. 7 and FIG. 8 corresponds to FIG. 8. Again, large tubes 19 and small open ended tubes 21 communicate between openings formed in first reflection wall 9''' and bulkhead wall 16'''. Helix members 25 are connected to tubes 19 and 21.

Preferably third edge echo openings 10 are placed in reflection wall 9'' and edge openings 10 are placed in reflection wall 9'''. The placement of the third echo edge openings opens up third accelleration chamber 31 between the reflection wall and the bulkhead which enables surges of exhaust gases to temporarily expand into another chamber. This further reduces backpressure during sudden needs for acceleration.

FIGS. 10–17 illustrate still another form of the invention. The primary characteristic is the use of an oval configuration for the muffler housing instead of a circular shape. Because the sound of an oval muffler is different from a circular muffler, drawings were believed to be necessary to cover this form of the invention and separate claims have been drawn. Because, however, of the obvious similarities, an identical numbering system has been used except with the addition of either the mark (') or ('''') to similar parts. A description of the muffler illustrated in FIGS. 10–17 is not repeated except where the structural differences require some further clarification.

Housing wall 2' is connected to eliptical walls 3' and 5' and in close fitting registration with eliptical walls 14', 9'''', 16'''' and 27'. As shown in FIGS. 11, 12, 13, 15 and 16, three large tubes 19' surround small tubes 21' with helical members 25' joining the tubes and communicate with openings to wall 9'''' and bulkhead 16''''. Third echo edge openings 10' are formed in wall 9'''' and permit gas to enter chamber 31'.

Operation of the oval muffler of FIGS. 10–17 is identical to the circular muffler described above except that reflection of sound waves from the eliptical walls of the muffler 1' are at different angles than the reflections of waves from the circular muffler. It has been found that the eliptical shape permits the muffler to be shorter in overall length.

Figure 15:
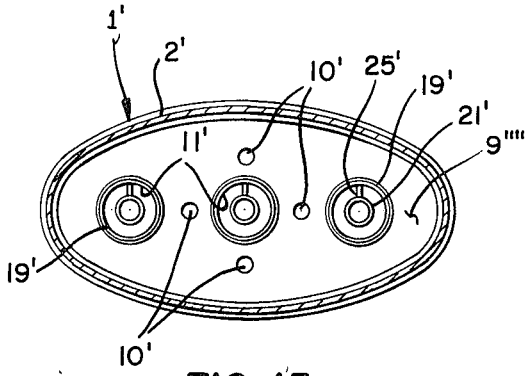
FIG. 15 is a cross sectional view of the muffler of FIG. 13 taken along line 15—15.
Figure 15A:
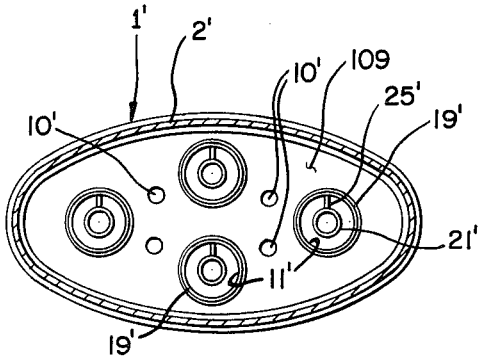
FIG. 15A is a cross sectional view of another form of the muffler taken act the same location as line 15—15 in FIG. 13.
Figure 16:
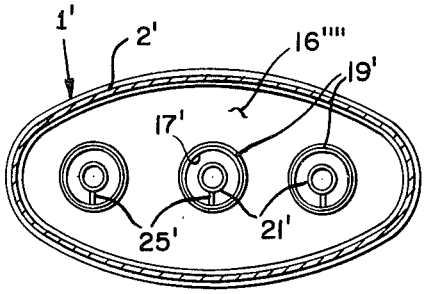
FIG. 16 is a cross sectional view of the muffler of FIG. 13 taken along line 16—16.
Figure 16A:
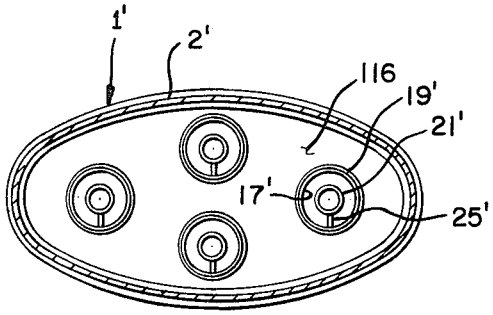
FIG. 16A is a cross sectional view of the form of the muffler illustrated in FIG. 15A taken at the same location as line 16—16 in FIG. 13.
Figure 17:
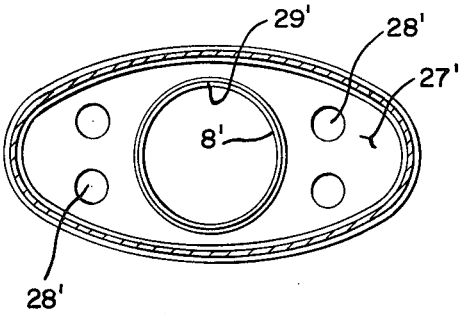
FIG. 17 is a cross sectional view of the muffler of FIG. 13 taken along line 17—17.

The tube cluster need not be three tubes in number. FIGS. 15A and 16A illustrate an oval muffler similar to that shown in FIG. 13 except that there are four tubes in the tube cluster instead of three. Thus, first reflection wall 109 is similar to first reflection wall 9'''' except that there are four openings for the receipt of large tubes 19', small tubes 21' and helix member 25'. These tubes join bulkhead wall 116 which is similar to bulkhead wall 16''''. Third Edge echo openings 10' are formed in wall 109 so that gas can expand into an acceleration chamber between wall 109 and bulkhead 116.

We claim:

1. An internal combustion engine muffler comprising:

a. an elongated housing having a curvilinear side wall, an inlet end wall formed with a first inlet opening, and an outlet end wall formed with a first outlet opening;

b. an inlet tube connected to said inlet end wall and communicating with said first inlet opening in said inlet end wall;

c. an outlet tube communicating with said first outlet opening in said outlet end wall;

d. a first internal relection wall axially spaced downstream from said inlet end wall forming a close fit with said curvilinear side wall and formed with a plurality of large tube openings;

e. a second internal reflection wall spaced between said inlet end wall and said first internal reflection wall forming a close fit with said curvilinear side wall and formed with a first edge echo orifice opening therethrough and a second inlet tube opening;

f. said inlet tube communicates with said second inlet tube opening in said second internal reflection wall;

g. a bulkhead wall axially spaced downstream from said first internal reflection wall forming a close fit with said curvilinear side wall and formed with a plurality of large tube openings axially aligned with said large tube openings in said first internal reflection wall;

h. at least three elongated internal large tube members extending from said internal reflection wall to said bulkhead wall and communicating with said large tube openings in said first internal reflection wall and said bulkhead;

i. inner small tube members coaxially mounted within each of said large tubes forming open ended pulse chambers;

j. helical members joining each of said inner small tubes and said large tube members;

k. a third internal reflection wall axially spaced downstream from said bulkhead wall forming a close fit with said curvilinear side wall and formed with a second edge echo orifice opening therethrough and a second outlet tube opening formed in alignment with said first outlet opening in said outet end wall;

l. said outlet tube is in communication with said second outlet tube opening in said third internal reflection wall;

m. a primary expansion chamber formed by said curvilinear side wall, said second internal reflection wall and said first internal reflection wall;

n. elongated swirl and pulse smoothing chambers formed between said small tubes and said internal large tubes and divided by said helical members;

o. a primary interference chamber formed by said curvilinear side wall, said bulkhead wall and said third internal reflection wall;

p. a first acceleration gas expansion chamber formed by said curvilinear side wall, said inlet end wall, and said second internal reflection wall;

q. a second acceleration gas expansion chamber formed by said curvilinear side wall, said third internal reflection wall and said outlet end wall;

r. said length of said primary expansion chamber and the length of said primary interference chamber are substantially greater than the length of said elongated internal large tube and inner small tube members; and s. said internal large tube and inner small tube member are positioned at substantially the mid-point of said housing.

2. A muffler as described in claim 1 comprising:

a. said internal large tubes, inner small tubes and said helical members are substantially co-extensive in length and their ends are substantially coterminus.

3. A muffler as described in claim 2 wherein:

a. said ends of said internal large tubes extend a minimal distance beyond said bulkhead member;

4. A muffler as described in claim 3 wherein:

a. said outlet tube extends a substantial distance upstream beyond said outlet end wall.

5. A muffler as described in claim 1 wherein:

a. said first internal reflection wall is formed with a plurality of third edge echo orifice openings therethrough; and b. a third acceleration gas expansion chamber formed by said curvilinear side wall, said first internal reflection wall and said bulkhead wall.

6. A muffler as described in claim 1 wherein:

a. there are at least eight elongated internal large tube members.

7. A muffler as described in claim 1 wherein said housing is oval in shape.

8. A muffler as described in claim 7 wherein:

a. there are at least four internal large tube members.

9. A muffler as described in claim 7 wherein:

a. said third internal reflection wall is formed with at least two echo edge openings therethrough.

* * * * *